United States Patent [19]

Wafer et al.

[11] 4,309,580

[45] Jan. 5, 1982

[54] DUAL ARCING CONTACTS FOR CIRCUIT BREAKER

[75] Inventors: John A. Wafer, Beaver; Louis N. Ricci; Alfred E. Maier, both of Beaver Falls, all of Pa.

[73] Assignee: Westinghouse Electric Corp., Pittsburgh, Pa.

[21] Appl. No.: 46,735

[22] Filed: Jun. 7, 1979

[51] Int. Cl.[3] ..... H01H 33/00

[52] U.S. Cl. ..... 200/144 R; 200/147 R; 200/146 R

[58] Field of Search ..... 200/144 R, 147 R, 146 R

[56] References Cited

U.S. PATENT DOCUMENTS

| | | | |
|---|---|---|---|
| 3,296,402 | 1/1967 | Meinders | 200/144 R |
| 3,681,548 | 8/1972 | Erickson | 200/144 R |
| 3,821,607 | 6/1974 | Matsko et al. | 200/292 |
| 4,229,630 | 10/1980 | Wafer et al. | 200/144 B |

*Primary Examiner*—Robert S. Macon

*Attorney, Agent, or Firm*—L. P. Johns

[57] ABSTRACT

A circuit interrupter characterized by a stationary contact and a movable contact which are operable along a predetermined path between open and closed positions to establish an arc, an arc chute for extinguishing the arc, a pair of spaced apart conductors extending from the movable contact to the arc chute which conductors provide parallel current paths for conducting an arc away from the contacts and into the arc chute.

4 Claims, 3 Drawing Figures

3
5
15
17
27
31
35
37
41
43
45
47
49
51
53
55
57
59
61
II

DUAL ARCING CONTACTS FOR CIRCUIT BREAKER

BACKGROUND OF THE INVENTION

1. Field of the Invention

This invention relates to a circuit interrupter and, more particularly, it pertains to dual arcing contacts therefor.

2. Description of the Prior Art

Most circuit breakers that comprise overcurrent protective devices have been using main contacts and an arcing contact. The arcing contact is so disposed that it makes contact first and breaks last, thereby protecting the main contacts. With high rating breakers more main contacts are required so that a single arcing contact is not sufficient to protect all of the main contacts. Moreover, for high short circuit currents a single arcing contact blows off and therefore causes arcing of the main contacts. Accordingly, there is a need for improvements in means for moving an arc away from the contact area.

SUMMARY OF THE INVENTION

It has been found in accordance with this invention that an improved protective device is provided for a circuit interrupter which comprises a stationary contact and a movable contact which are operable along a predetermined path between open and closed postions to establish an arc, circuit breaker means including a movable contact carrying arm for moving the movable contact, an arc chute for extinquishing the arc including a plurality of spaced apart plates, said plates being disposed substantially transversely of the established arc and extending completely across the arc chute, said arm including at least two spaced apart conductors extending toward the plates an arcing contact on each conductor, the conductors having facing end portions extending from the movable contacts and turned toward each other, the conductors being disposed so as to provide parallel current paths which conduct an arc away from the contacts and into the arc chute, and arcing contacts being disposed between the movable contacts and the end portions.

An advantage of the device this invention is that it provides one or more main contacts and provides for bending of the arcing contact end portions toward each other to improve short circuit interruption.

DESCRIPTION OF THE PREFERRED EMBODIMENT

Figures 1, 3:
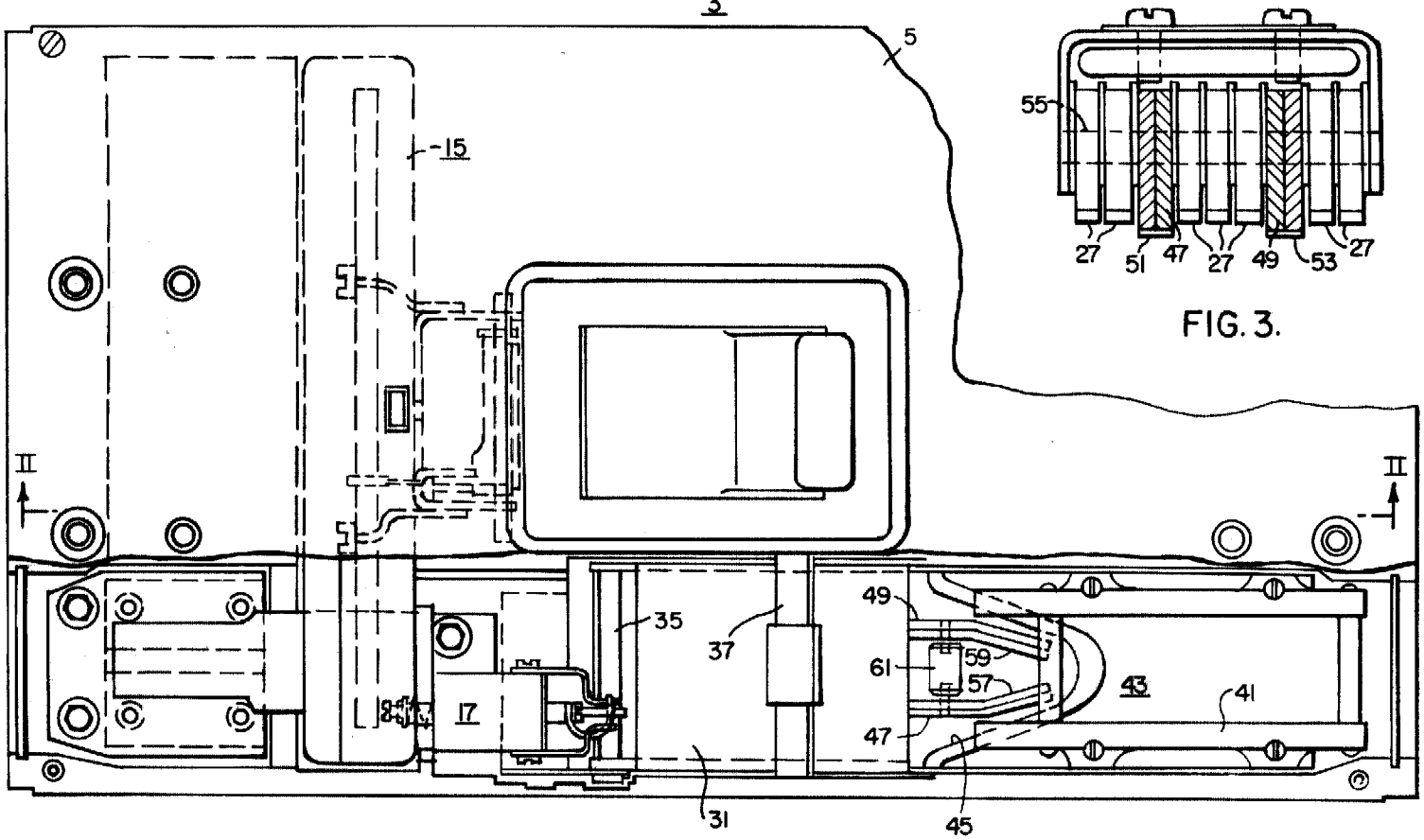
FIG. 1 is a top plan view, with part broken away, of a circuit breaker constructed in accordance with the principles of this invention.
FIG. 3 is a vertical end view taken on the line III—III of FIG. 2.

In the drawings a circuit breaker is generally indicated at 3 and it comprises an insulating housing 5 and a circuit breaker mechanism 7 supported within the housing. The housing 5 comprises an insulating base 9 and an insulating cover 11 therefore.

The circuit breaker 3 is similar to that disclosed in U.S. Pat. No. 3,821,607 which is incorporated by reference as part hereof. Because of the full disclosure in that patent, the description of the operating parts is limited herein to the basic structure and operation. The circuit breaker mechanism comprises an operating mechanism 13, a latch and trip device 15, and a trip actuator 17. The circuit breaker 3 is a three-pole device comprising three compartments disposed in a side-by-side relationship. The center pole compartment (FIG. 2) is separated from the two outer pole compartments by insulating the barrier means formed with the housing base 9 and cover 11. The operating mechanism 13 is disposed in the center pole compartment and is a single operating mechanism for actuating the contacts of all three pole units.

Each pole unit comprises a stationary contact 21 that is fixedly secured to a rigid main conductor 23. In each pole unit, a movable contact 27 is secured such as by welding to a contact arm 29 that is mounted on a switch arm 31. The assembly of the arms 29, 31 is pivotally supported at one end thereof on a support bracket 33 by a pivot pin 35. The switch arms 31 of all three pole units are connected to move in unison by means of common insulating tie bar 37 that is rigidly connected to all three of the switch arms.

Figure 2:
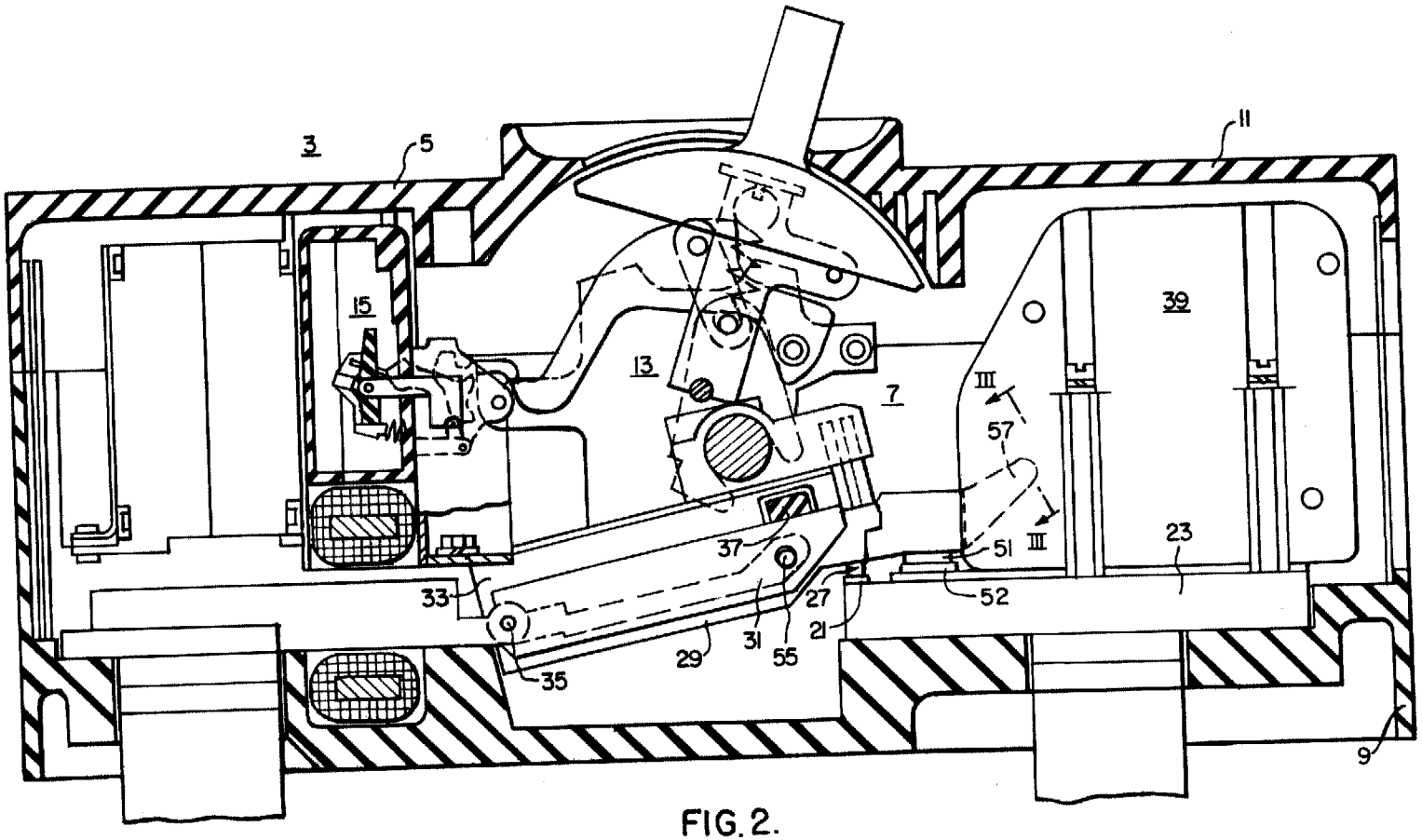
FIG. 2 is a sectional view, with parts broken away, taken generally along the line II—II of FIG. 1.

In each pole unit, an arc extinguishing unit or arc chute 39 is provided to extinguish the arcs drawn between the associated contacts 21, 27. Each arc chute 39 comprises an insulating housing 41 and a plurality of magnetic steel plates 43 (FIG. 1) supported within the housing. The movable contact 27 moves within a generally V-shaped opening 45 in the stacked plates 43. As shown in FIGS. 1 and 2, the contact arm 29 comprises a plurality, such as two, contact mounting arms 47, 49 that are mounted with the assembly of arms 29, 31 for mounting arcing contacts 51, 53 respectively. The arms 47, 49 are pivotally mounted on the assembly by a pin 55. When the movable contact 27 is raised from the stationary contact 21, the arcing contacts 51, 53 remain momentarily in contact with the stationary contact 52, whereby an arc is formed through the arcing contacts 51, 53 and the stationary contact 52.

In accordance with this invention, the arms 47, 49 comprise spaced-apart extensions or arc horns 57, 59 which extend toward the plates 43 of the arc chute 39. As shown in FIG. 1 the arc horns 57, 59 are turned toward each other at an angle and their outer ends are spaced apart. Movable contacts 27 are mounted.

Inasmuch as the arms 47, 49 conduct parallel current, the arc is attracted from the arcing contacts 51, 53 to the spaced extremities of the arc horns 57, 59 and thereby transferred to the arc chute plate 43 more expeditiously, because the inturned shape of the arc horns allows the use of deion arc chutes. An ancillary advantage to the inturned arc horns 57, 59 is that the arcing contacts 51, 54 are spaced by the main conductors which improves the commutation of the arc from the main movable contacts 27 to the arcing contacts and then to the ends of the arcing horns 57, 59. A spacer 61 is located between the arc horns 57, 59 to prevent the tips from touching and welding together.

In conclusion, the device of this invention enables the employment of one or more main contacts between the arcing contact arms, the ends of which are inclined toward each other to greatly improve short circuit interruption. Since parallel currents attract each other, the "V" shape of the arcing contacts cause the two arcs to go into the center of the arc chute much faster with less burning along the sides of the arc chute plates.

What is claimed is:

1. A circuit interrupter comprising a stationary contact and a movable contact which are operable along a predetermined path between open and closed positions to establish an arc, circuit breaker means including a movable contact carrying arm for moving the movable contact, an arc chute for extinguishing the arc including a plurality of spaced apart plates, said plates being disposed substantially transversely of the established arc and extending across the arc chute, said arm including at least two spaced-apart conductors extending toward the plates, the conductors having facing end portions turned toward each other, and the conductors being disposed to provide parallel current paths which conduct an arc away from the contacts and into the arc chute.

2. The circuit interrupter of claim 1 in which an arcing contact is mounted on each conductor, and said end portions extending from the arcing contacts toward the arc chute.

3. The circuit interrupter of claim 2 in which the arcing contacts are disposed between the movable contact and the end portions.

4. The circuit interrupter of claim 3 in which spacer means are provided for maintaining the end portions at spaced-apart positions.

* * * * *